US008579414B2

(12) United States Patent
Biegelsen et al.

(10) Patent No.: US 8,579,414 B2
(45) Date of Patent: Nov. 12, 2013

(54) SELF-ASSEMBLING STRUCTURES FOR ELECTROSTATIC EXTRACTION OF PIGMENTS FROM LIQUID INKS FOR MARKING

(75) Inventors: David K. Biegelsen, Portola Valley, CA (US); Steven A. Buhler, Sunnyvale, CA (US); Scott A. Elrod, La Honda, CA (US); John S. Fitch, Los Altos, CA (US); David K. Fork, Los Altos, CA (US); Babur B. Hadimioglu, Angelholm (SE); Richard Stearns, Soquel, CA (US)

(73) Assignee: Xerox Corporation, Norwalk, CT (US)

( * ) Notice: Subject to any disclaimer, the term of this patent is extended or adjusted under 35 U.S.C. 154(b) by 2 days.

(21) Appl. No.: 12/646,180

(22) Filed: Dec. 23, 2009

(65) Prior Publication Data

US 2011/0149006 A1 Jun. 23, 2011

(51) Int. Cl.
*B41J 2/06* (2006.01)

(52) U.S. Cl.
USPC ..... 347/55

(58) Field of Classification Search
USPC ..... 347/73, 74, 75, 76, 79, 55
See application file for complete search history.

(56) References Cited

U.S. PATENT DOCUMENTS

| | | | | |
|---|---|---|---|---|
| 5,613,861 | A | 3/1997 | Smith et al. | |
| 5,909,230 | A * | 6/1999 | Choi et al. | 347/54 |
| 5,914,218 | A | 6/1999 | Smith et al. | |
| 6,543,885 | B2 * | 4/2003 | Bahl et al. | 347/76 |
| 6,794,737 | B2 | 9/2004 | Romano et al. | |
| 6,848,175 | B2 | 2/2005 | Fork et al. | |
| 6,905,188 | B1 | 6/2005 | Teape et al. | |
| 6,947,291 | B2 | 9/2005 | Chua et al. | |
| 7,000,315 | B2 | 2/2006 | Chua et al. | |
| 7,207,651 | B2 * | 4/2007 | Amemiya | 347/46 |
| 7,241,420 | B2 * | 7/2007 | Hantschel et al. | 422/502 |
| 7,334,882 | B2 * | 2/2008 | Nakazawa | 347/77 |
| 7,426,117 | B2 | 9/2008 | Van Schuylenbergh et al. | |
| 2002/0030566 | A1 * | 3/2002 | Bozler et al. | 333/246 |
| 2007/0120900 | A1 * | 5/2007 | Kosuge et al. | 347/76 |

* cited by examiner

*Primary Examiner* — Julian Huffman
*Assistant Examiner* — Sharon A Polk
(74) *Attorney, Agent, or Firm* — Fay Sharpe LLP

(57) ABSTRACT

A fabricated structure for use with an associated marking device is provided. In one form, the fabricated structure includes a self-lifting spring finger having a nib for marking.

14 Claims, 9 Drawing Sheets

SELF-ASSEMBLING STRUCTURES FOR ELECTROSTATIC EXTRACTION OF PIGMENTS FROM LIQUID INKS FOR MARKING

BACKGROUND

The exemplary embodiments relate to a fabricated structure. It finds particular application in electrostatic extraction of pigments from a liquid ink for marking, and will be described with particular reference thereto. However, it is to be appreciated that the present exemplary embodiments are also amenable to other like applications.

Digital printing processes using liquid inks with suspended particles have been developed for high quality and high speed printing targeted in commercial and industrial markets. However, at this time, some print head fabrication schemes do not lend themselves to batch fabrication and excellent printing characteristics. A planar batch-fabricated process would be particularly beneficial. The technology demands well defined electrostatic field concentrators (tips) that can be precisely and uniformly positioned relative to each other. Preferably, tips would have internal structures and overall shapes to optimize capillary and electrostatic forces.

FIGS. 1A and 1B schematically illustrate a known system 100 for pigment extraction from an electrically insulating liquid. A conducting nib or tip 102 extending slightly above the flowing liquid reservoir 104 is coated with liquid 106 by capillary forces. Positively charged pigment particles 108 (Illustrated in FIG. 1B) are suspended within the fluid. A positive pulse 110 applied to the nib 102 propels the pigment particles toward the 'ground electrode' 114 which extracts the concentrated particles in a droplet from the nib or tip 102.

In addition, other structures known as CLAW structures have found use in photo-lithographically patterned spring structures. U.S. Pat. No. 6,794,737 B2 to Fork et al., and U.S. Pat. No. 5,613,861 A to Smith et al., both disclose a stress-balancing layer formed over portions of a self-lifting spring finger that remain attached to an underlying substrate to counter internal stress. These structures are based on depositing and patterning metal layers with controlled vertical stress gradients. Upon release the metal strips curl up out of the plane of fabrication. Additional layers are formed by various methods such as sputtering, plating, etc. and combinations, thereof.

INCORPORATION BY REFERENCE

The following references, the disclosures of which are incorporated herein in their entireties by reference, are mentioned: U.S. Pat. No. 5,613,861 A, Smith et al., U.S. Pat. No. 6,794,737 B2, Fork et al., and U.S. Pat. No. 6,905,188 B1, Teape et al.

BRIEF DESCRIPTION

In accordance with one aspect of the exemplary embodiment, a planar fabricated structure for use with an associated marking device selected from a plurality of marking device types for making marks on an associated substrate is provided. The planar fabricated structure includes a substrate and a self-lifting spring finger. The self-lifting spring finger includes an unlifted anchor portion attached to the substrate. A release portion extends over the substrate and has a proximal end and a distal end. The distal end includes a tip operative to facilitate the emission of marking fluid. The release portion of the self-lifting spring finger lifts out of the plane when etched.

In accordance with another aspect, a planar fabricated structure for use with an associated marking device selected from a plurality of marking device types for making marks on an associated substrate is provided. The planar fabricated structure includes a substrate and a self-lifting spring finger. The self-lifting spring finger includes an unlifted anchor portion attached to the substrate. A release portion extends over the substrate and has a proximal end and a distal end. The distal end includes a tip operative to facilitate the emission of marking fluid. An electrically insulating tether strip is layered across the release portion. The release portion of the self-lifting spring finger lifts out of the plane when etched.

In accordance with another aspect, a planar fabricated structure for use with an associated marking device selected from a plurality of marking device types for making marks on an associated substrate is provided. The planar fabricated structure includes a substrate and a plurality of self-lifting spring fingers. The plurality of self-lifting spring fingers each includes an unlifted anchor portion attached to the substrate. A release portion extends over the substrate and has a proximal end and a distal end. The distal end includes a tip operative to facilitate the emission of marking fluid. The plurality of self-lifting spring fingers is arranged so that the tips are clustered. The release portion of the self-lifting spring finger lifts out of the plane when etched.

In accordance with another aspect, a planar fabricated structure for use with an associated marking device selected from a plurality of marking device types for making marks on an associated substrate is provided. The planar fabricated structure includes a substrate and a plurality of self-lifting spring fingers. The plurality of self-lifting spring fingers includes an unlifted anchor portion attached to the substrate. A release portion extends over the substrate and has a proximal end and a distal end. The distal end includes a tip operative to facilitate the emission of marking fluid. The planar fabricated structure further includes an electrically insulating tether strip layered across the release portion of each self-lifting spring finger. A plurality of tether strip rows and a plurality of tether strip columns form a tether net structure. The release portion of the self-lifting spring finger lifts out of the plane when etched.

One advantage of at least one embodiment is the reduction of metal required to sputter. This may reduce the cost of sputtering by reducing machine time material consumption, and downtime for preventative maintenance (flaking). Additionally, by enabling the utilization of thinner self-lifting spring, the emitter sharpness may be more controllable since it will be determined more by the lithography than by the undercut evolution.

Another advantage of at least one embodiment is that tips can be patterned to optimize capillary and electrostatic forces.

Another advantage of at least one embodiment is that fabrication is planar and batch produced for low cost, high precision, and integrity with electronics.

Another advantage of at least one embodiment is that the three dimensional structure is self-assembling.

Another advantage of at least one embodiment is that tether nets can support aperture plates Another advantage of at least one embodiment is that vertical emitters can be fabricated with varied height.

Another advantage of at least one embodiment is that mechanically stable emitters with sharp ends may be batch processed.

Still further advantages of the present disclosure will become apparent to those of ordinary skill in the art upon reading and understanding the following detailed description of the preferred embodiments.

DETAILED DESCRIPTION

According to the presently described embodiments, planar, batch fabricated structures use precisely patterned, self-assembling features to position electrostatic ink nibs or tips for use in suitable marking devices or systems. In one form, a system uses single or multi-layers with controlled vertical stress gradients to create three-dimensional structures upon release from the substrate. Various assemblies are proposed which allow inexpensive, highly integrated, highly functional digital marking systems to be fabricated.

In an exemplary embodiment, FIGS. 2A, 2B, 3A, and 3B illustrate a fabricated structure which enables cost effective and precise fabrication of nib or tip arrays and their integration with ancillary fluid handling structures as well as drive electronics. A basic notion, in at least one form, is the use of CLAW-like self-assembling elements to provide the nibs or tips. A nib or tip is part of the CLAW-like structure which comes into near or actual contact with a marking surface to deposit agglomerated positively charged pigment particles.

Figure 2A:
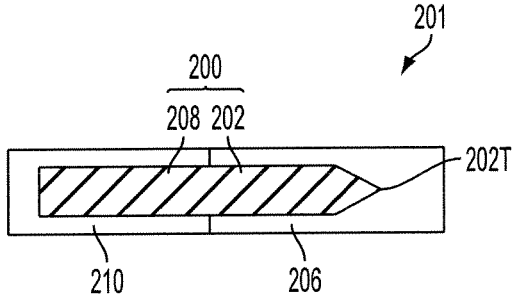
FIG. 2A is a schematic top view of a release portion structure (including a tip) before release.
Figure 2B:
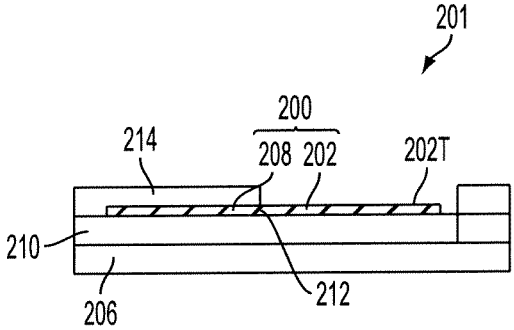
FIG. 2B is a schematic side view of a release portion structure before release of the release portion structure (including a tip) as shown in FIG. 2A.
Figure 3A:
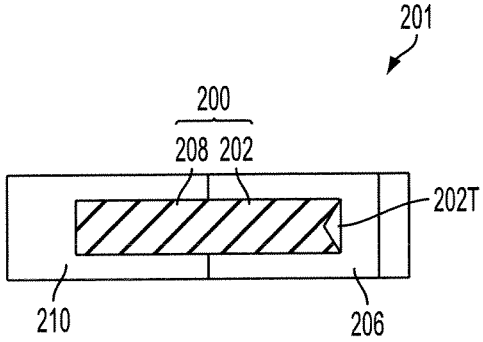
FIG. 3A is a schematic top view of a release portion structure (including a tip) after release.
Figure 3B:
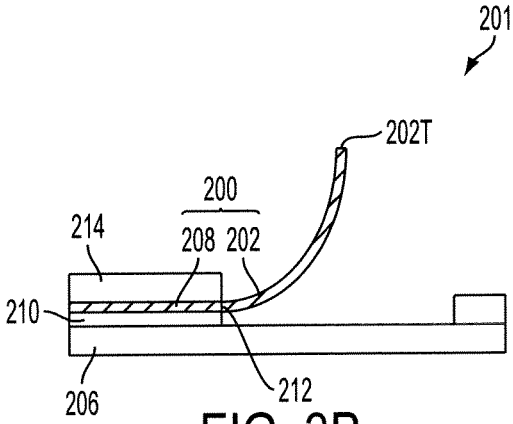
FIG. 3B is a schematic side view of a fabricated structure after release of the release portion structure (including a tip) as shown in FIG. 3A.

In this regard, FIGS. 2A and 2B show a fabricated structure in an unrelaxed state which, upon release, transforms into a relaxed three-dimensional configuration shown in FIGS. 3A and 3B. It should be appreciated that in at least one form, the release of the structure of the presently described embodiment into a relaxed state occurs during etching/fabrication.

As shown in FIGS. 2A and 2B, a self-lifting spring finger 200 for use with an associated marking device is shown within a fabricated structure 201. It should be appreciated that the fabricated structure 201 may be used in conjunction with any suitable associated marking device operative for facilitating the emission of marking fluid. The fabricated structure 201 generally includes a substrate 206 and a release layer 212, and one or more layers which comprise the self-lifting spring finger 200, which includes the unlifted anchor portion 208 attached to the substrate 206 via a support pad 210. The fabricated structure further includes the release portion 202 extending over the release layer 212 and substrate 206. Upon sacrificial etching of at least part of the release layer 212 the released finger relaxes the internal stresses to form the desired three dimensional structures. In one embodiment, the self-lifting spring finger comprises a metal with a built-in stress gradient which, upon release, will be perpendicular to the substrate. (The stress nearest the substrate is compressive and the stress near the top surface is tensile so that upon release the finger relaxes by bending up and away from the substrate.) The release portion 202 has a proximal end 212 at the edge of the unlifted anchor portion 208 and substrate 206 and a distal end 202T. As illustrated in FIG. 2B, the fabricated structure further includes an anchor pad 214 on the anchor portion 208 of the self-lifting spring finger 200. In a second case the self-lifting spring finger 200 comprises a non built-in stress gradient metal and an overlayer portion comprising a built-in stress gradient.

With regard to FIG. 3A, the self-lifting spring finger 200 is shown in a relaxed state after release. The tip 202T extends out of the page as shown. The tip 202T is shaped accordingly to enhance capillary definition of agglomerated positively charged pigment particles allowing for emission of ink or marking fluid in, for example, a device for electrostatic extraction of pigmented ink for marking.

With regard to FIG. 3B, a cross-sectional view of FIG. 3A is illustrated. The fabricated structure 201 for use with an associated marking device shows the release portion 202 of self-lifting spring finger 200 in a relaxed state after release.

Figure 4A:
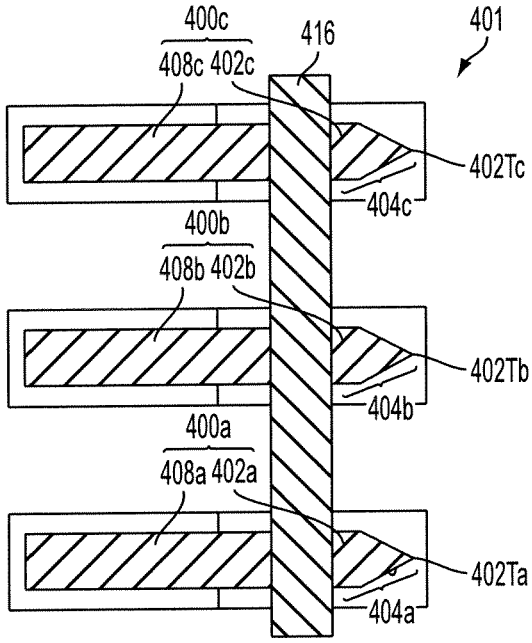
FIG. 4A is a schematic top view of a fabricated structure with tethered tips.
Figure 4B:
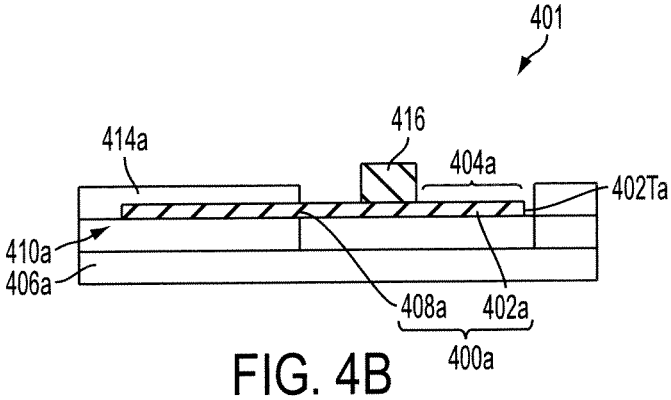
FIG. 4B is a schematic side view of a fabricated structure with tethered tips.

In another embodiment, FIGS. 4A and 4B illustrate self-lifting spring fingers 400*a-c* with tethered tips within a structure 401. It should be appreciated that the fabricated structure 401 may be used in conjunction with any suitable associated marking device operative for facilitating the emission of marking fluid. As shown in FIG. 4A, the self-lifting spring fingers 400*a-c* for use with an associated marking device are shown. The self-lifting spring fingers 400*a-c* generally includes release portions 402*a-c*. The release portions 402*a-c* further include distal ends 404*a-c*. The distal ends 404*a-c* form a set of tips 402Ta-Tc. An electrically insulating tether strip 416 is layered across and bonded to fingers 400*a-c* near the distal ends 404*a-c* of the release portion 402*a-c*. Also shown are anchor portions 408 a-c.

In at least one form, the shape of the tips 402Ta-Tc, which can be formed photo-lithographically, or by other suitable techniques, are uniform from tip to tip. The respective height of the tips 402Ta-Tc can be controlled across the entire substrate to be at least within +/−5 microns of one another, e.g. within +/−3 microns, or +/−2 microns. The height is selected to keep field concentrations at the tips constant.

The relative distance between tips 402Ta-Tc are also configured to be uniform. The deviation for the relative positions between the tips, such as 402Ta-Tc, may be no more than +/−10 microns, and e.g. less than about +/−7 microns, or +/−5 microns. According to the presently described embodiments, the way to effectively lock the tip-tip distances is to provide a tether strip 416 between tips.

With regard to FIG. 4B, a cross-sectional view of fabricated structure 401 which includes self-lifting spring finger 400*a* is illustrated. It is to be appreciated that self-lifting spring fingers 400*b* and 400*c* may be similarly illustrated.

The fabricated structure 401 for use with an associated marking device shows the self-lifting spring finger 400*a* in an unrelaxed state with the electrically insulating tether strip 416 layered across and bonded to finger 409 near the distal end 404*a* of the release portion 402*a*.

Figure 5A:
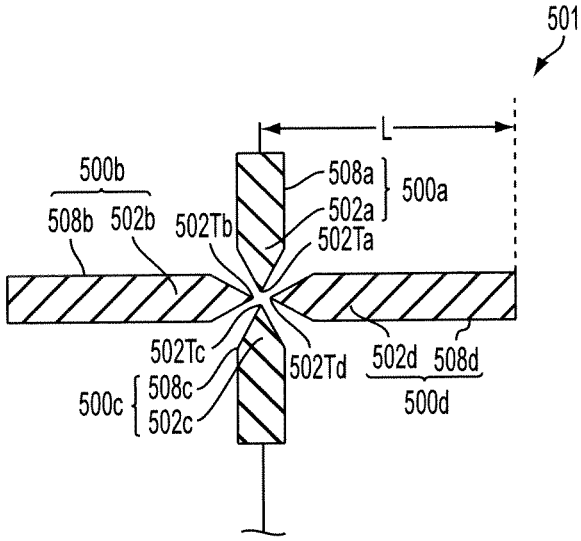
FIG. 5A is a schematic top view of a fabricated structure with clustered tips.
Figure 5B:
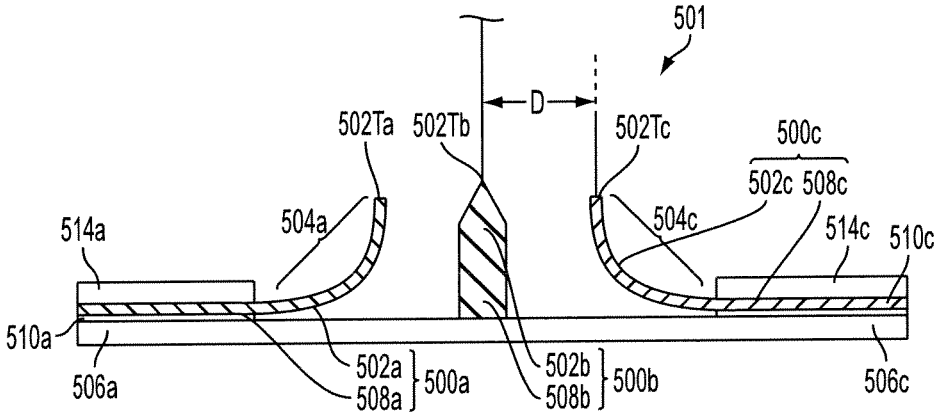
FIG. 5B is a schematic side view of a fabricated structure with clustered tips.

In another embodiment, FIGS. 5A and 5B collectively illustrate a fabricated structure 501 with clustered tips. It should be appreciated that the fabricated structure 501 may be used in conjunction with any suitable associated marking device operative for facilitating the emission of marking fluid. With regard to FIG. 5A, self-lifting spring fingers 500*a-d* are shown within a structure 501. The self-lifting spring fingers 500*a-d* include a plurality of release portions 502*a-d* arranged perpendicularly to each other forming clustered tips 502Ta-Td.

With regard to FIG. 5B, a cross-sectional view of fabricated structures 501 which include self-lifting spring fingers 500*a*, 500*b*, and 500*c* is illustrated. The fabricated structure 501 for use with an associated marking device shows self-lifting spring fingers 500*a-c* in a relaxed state. It is to be appreciated that a fabricated structure 501 would include self-lifting spring finger 500*d* but is not similarly illustrated for ease of reference.

It is desirable in some forms to have multiple tips, such as, 502Ta-Td clustered to form a single capillary structure. The individual tips 502Ta-Td cluster can be addressed individually to enable some drop steering or digital gray level ejection.

With regard to FIG. 5B, the clustered tips may form approximately a 90° bend satisfying the following Equation 1:

$$D=L(1-2/\pi),$$

wherein, D is the distance between adjacent distal ends, for example, 504*b* of the release portion 502*b* and 504*c* of the release portion 502*c*. L, as illustrated in FIG. 5A, is the distance between the tip 502 Td of spring finger 500*d* and the proximal end of spring finger 500*d*, that is, at the release end of the anchor. The formula is precise only when the distance between tips in FIG. 5A is negligible compared with the finger length L, that is where L is very nearly equal to the distance from the anchor to the midpoint of the unreleased cluster.

Figure 6A:
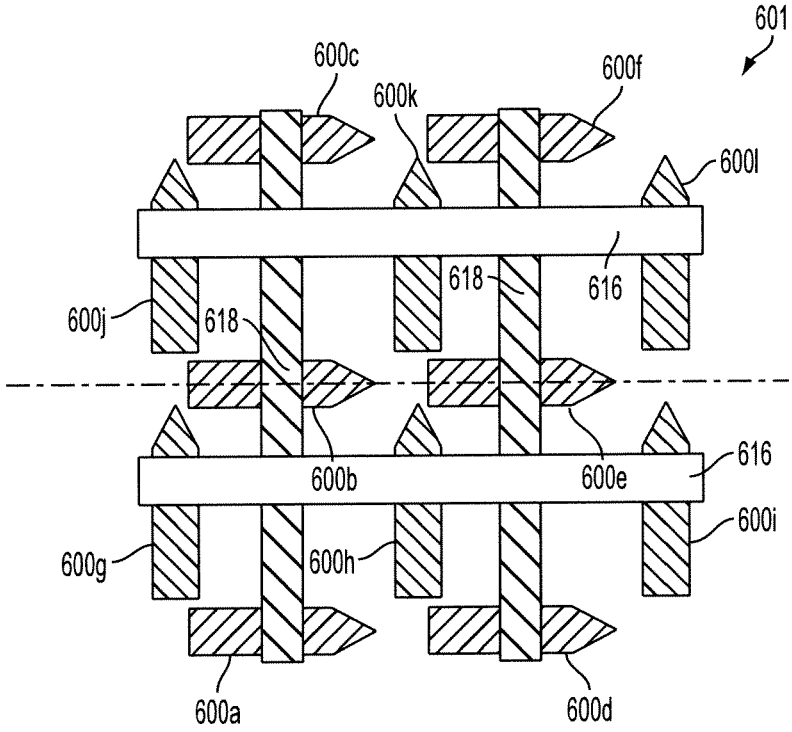
FIG. 6A is a schematic top view of a fabricated structure with a tether net and supported aperture plate.
Figure 6B:
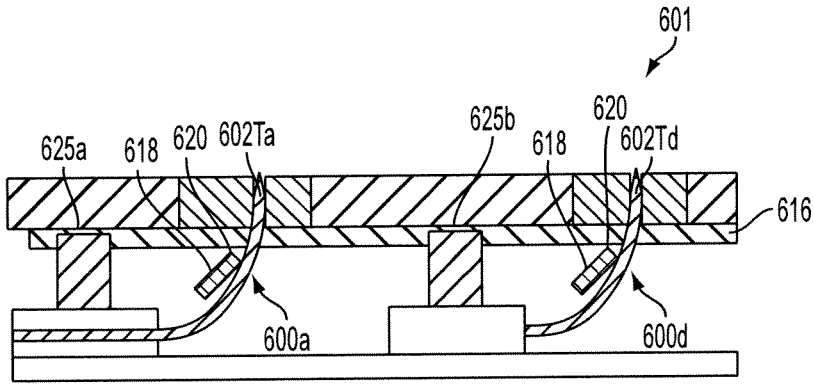
FIG. 6B is a schematic side view of a fabricated structure with a tether net and supported aperture plate.

In another embodiment, FIGS. 6A and 6B illustrate a fabricated structure with a tether net and supported aperture plate (not shown in FIG. 6A). Tethering of two-dimensional arrays of tips can be implemented as shown in FIGS. 6A and 6B. With regard to FIG. 6A, self-lifting spring fingers 600*a-f* and 600*g-l* are shown within a structure 601. The self-lifting spring fingers 600*a-f* and 600*g-l* are provided with a plurality of tether strip rows 618 and a plurality of tether strip columns 616, respectively to form a tether net structure. Not shown are sacrificial spacer pads between the two sets of tethers. Before spring release the sacrificial spacer pads are etched away leaving the two sets of tethers free to move independently of each other.

With regard to FIG. 6B, a partial cross sectional view of fabricated structure 601 which includes self-lifting spring fingers 600*a*, and 600*d* is provided. It should be appreciated that the fabricated structure 601 may be used in conjunction with any suitable associated marking device operative for facilitating the emission of marking fluid. It is also to be appreciated that fabricated structure 601 may also include self-lifting spring fingers 600*b-c* and 600*e-l* and could be similarly illustrated. The fabricated structure 601 includes electrically insulated tether strips 616, 618 layered across release portions 600*a* and 600*d*. A connection point 620 of tether strips is also known.

The fabricated structure further includes, for example, an aperture plate 625*a* (which may take a variety of forms to accommodate the structure and operation of the marking device) sitting on the tether net structure or at least on the higher set of tethers if they do not end as being co-planar. The fabricated structure further includes a structure for a supporting aperture plate 625*b* (which also may vary in configuration). For ease of illustration, the operative plate and supporting structure are not shown in FIG. 6A. The tethers can contact each other when tips are relaxed to form an interlocking structure either mechanically or by bonding of tethers at cross points.

It should be appreciated that the spring fingers and associated structures take substantially the same form and operate in substantially the same manner (except where noted) in all of the embodiments described in FIGS. 2A-8.

Similar structures can be made on small scale using silicon micro-fabrication processes. The preferred embodiment uses glass, plastic, printed circuit board or co-fired ceramic substrates and large area photo-lithographic or soft-lithographic processes, and combinations thereof.

Figure 7:
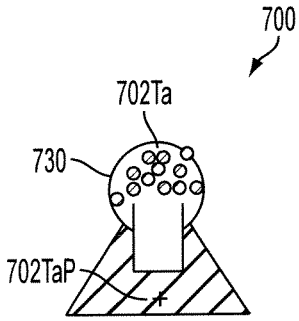
FIG. 7 is a schematic illustration of a typical tip.

In another embodiment, FIG. 7 illustrates a shaped tip for self-lifting spring finger 700. The self-lifting spring finger as previously described above in FIGS. 1-6 may include a shaped tip. The self-lifting spring finger 700 generally includes a shaped tip 702Ta that can be positively charged so that tip 702TaP located at the distal end of a release portion of the self-lifting spring finger 700 holds and can emit agglomerated positively charged pigment particles 730. The shapes of the tip may include convex shapes such as a circle, triangle, square, rectangle, parallelogram, trapezoid, rhombus, octagon, pentagon, and hexagon, and combinations thereof, as well as re-entrant structures as exemplified by fountain pen nibs or tips. The tip 202T is shaped accordingly to enhance capillary definition of agglomerated positively charged pigment particles allowing for emission of ink or marking fluid in, for example, a device for electrostatic extraction of pigmented ink for marking. The fabricated structures as previously described above may be precisely patterned and self-assembling.

In another embodiment, clawjet fingers having a more vertical orientation at the tip may be preferred over more circular fingers at 90 degrees as has been described thus far. The concept is simple and can be implemented without added mask count.

During the sputtering, one applies a balancing counter-moment load layer over the stress-gradient layer. This allows later creation of an end portion of the spring with very large radius. The base segment will bend tightly. At metal definition, all layers are etched down to the release layer. At the release stage, release window photo resist defines the spring base and additional resist over the end segment protects the end from a separate etch bath that removes the counter-moment material from the base-segment prior to release etch. The base-segment is designed to bend to 90 degrees, whereupon the end-segment extends vertically to a designed height.

Figure 8A:
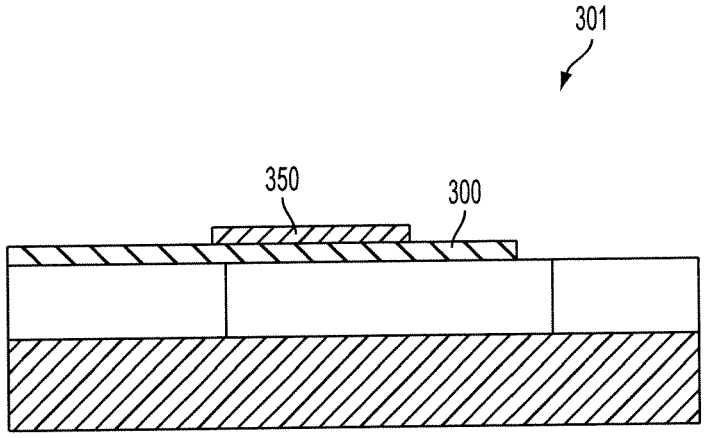
FIG. 8A is a schematic side view of a release portion structure before release of the release portion structure (including a tip)
Figure 8B:
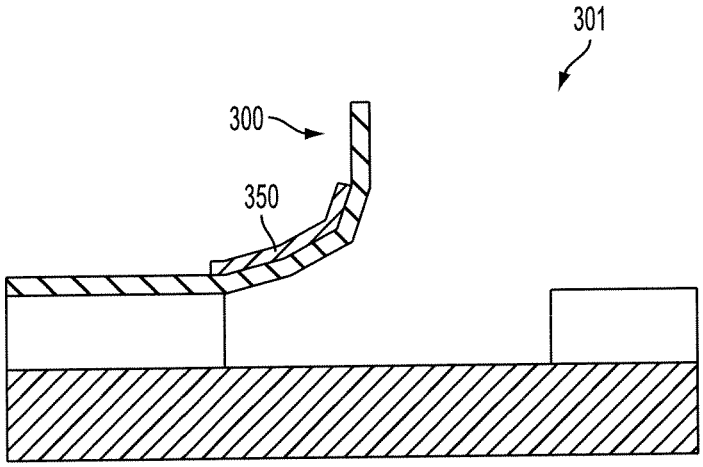
FIG. 8B is a schematic side view of a fabricated structure after release of the release portion structure (including a tip)

With respect to FIGS. 8A and 8B, an alternative method may include using a non-stressed layer to define the self-lifting spring finger 300 within the fabricated structure 301. The fabricated structure 301 would further include layer 350. The layer 350 may comprise at least one of a stressed metal or a second material (with built-in uniform stress) which acts like a bimetallic strip, patterned to overlie the self-lifting spring finger 300 at a position to provide the bending torque where it is needed.

This idea permits adjacent tips with varied height without varied angle. For example, one could make structures that can tune the drop size over a wider range by adjusting the potentials on the adjacent varied-height emitters. The concept may work with single segment beams, however, the angle and height will both vary with varied finger length.

Figure 9:
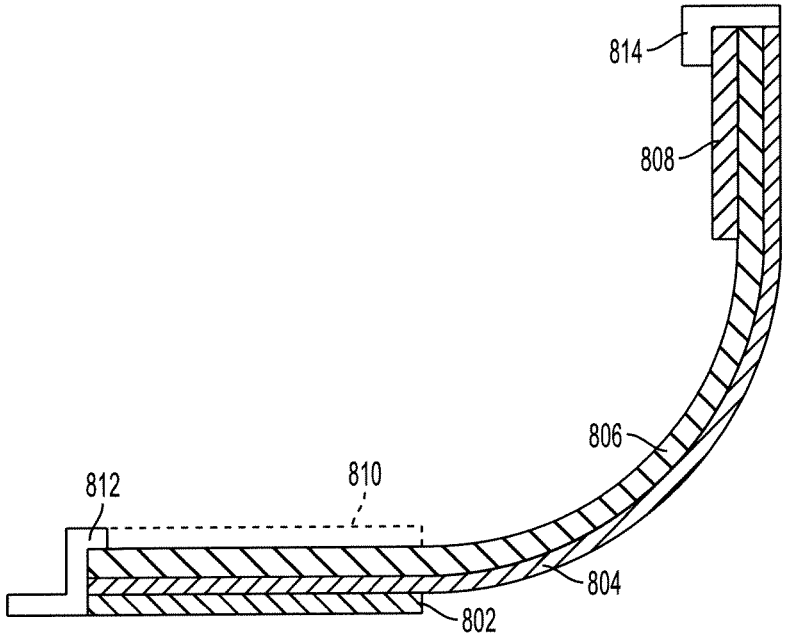
FIG. 9 is a schematic of a finger with a vertical terminating segment.

In this regard, FIG. 9 illustrates a structure for a finger with a vertical terminating segment. The fabricated structures as previously described may include a counter moment layer processed onto the end of the spring to create a vertical segment. The vertical terminating segment 800 generally includes a release layer 802, an insulating layer 804, a self-lifting spring 806, a counter moment layer 808, an open window mask 810, an end window mask 812, and a tip mask 814.

If one requires a strong rigid shaft that is structurally reinforced with thick plated metal, terminated by a lithography-limited sharp tip, this can be done without added mask count (e.g., still two levels). This can potentially make an excellent field concentrating structure that can withstand considerable amounts of fluid flow.

Long springs that bend to 90 degrees or more tend to become floppy, but plating can stiffen the structure. To avoid blunting the emitter section one would like to plate everywhere except the tip. Recent developments show how to adhere stress metal to plastic. It is proposed here to create a lifting cantilever that takes along a bottom layer of flexible insulator such as polyimide. The first metal mask is used to define both the metal and the bottom insulator down to the release layer as shown in FIG. 9. At release window definition, a terminating cap of insulating resist is placed over the tip. The cap lifts with the finger. The entire structure is then batch-plated. Plated metal goes only onto the top and sides of the base segment of the spring. The resist is then stripped, leaving behind a structure with strong, rigid emitters with sharp tips. The bottom insulator can also be stripped from the springs at this point if it interferes with the operation of the device.

Figure 1A:
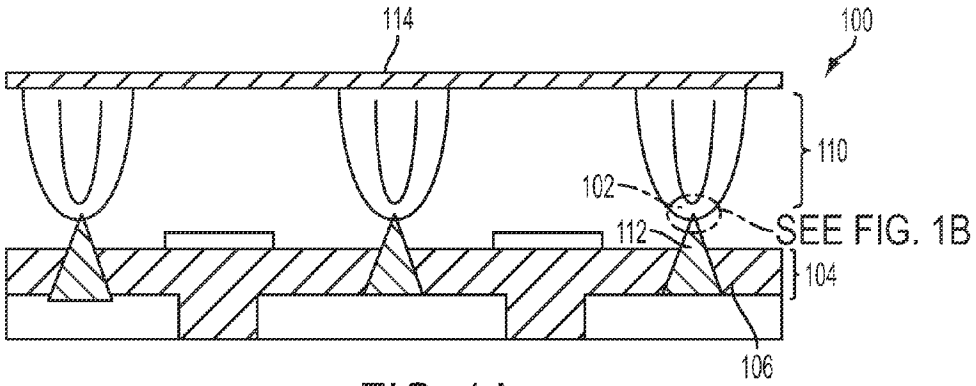
FIG. 1A PRIOR ART
FIGS. 1A and 1B is a schematic illustration of a generic electrostatic marking configuration.
Figure 1B:
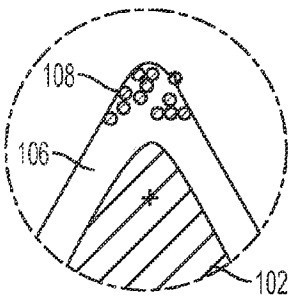
FIG. 1B PRIOR ART

While the fabricated structure(s) have been described in terms for use with any suitable associated marking device, it is also contemplated that the structure(s) may find use in forming the known system 100 as illustrated in FIGS. 1A and 1B. That is, the fabricated structure(s) may be suitable for use in improving current technology using high quality and high speed printing. The fabrication schemes may allow batch fabrication and excellent printing characteristics. The planar batch-fabricated process may be beneficial since current technology requires well defined electrostatic field concentrators (tips) that can be precisely and uniformly positioned relative to each other. The fabricated structure may include tips having internal structures and overall shapes to optimize capillary and electrostatic forces. In this regard, the structures of the presently described embodiments can be used to provide suitably and/or selectively positioned nibs or tips so that ink or pigment particles can be extracted according to various known techniques.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A planar fabricated structure for use with an associated marking device, the fabricated structure comprising:

a substrate configured to be integrated with a fluid handling structure of an associated marking device; and, a self-lifting spring finger configured to be integrated with drive electronics of the associated marking device, the self-lifting spring finger including an unlifted anchor portion attached to the substrate, a release portion extending away from the substrate, wherein the release portion includes a proximal end and a distal end, the distal end comprising a tip operative to serve as an electrostatic field concentrator to facilitate electrostatic extraction of marking fluid from a reservoir of marking fluid of the associated marking device toward a marking surface.

2. The planar fabricated structure of claim 1, wherein the self-lifting spring finger comprises a metal with a built-in stress gradient.

3. The planar fabricated structure of claim 1, wherein the self-lifting spring finger comprises a portion comprising a built-in stress gradient.

4. The planar fabricated structure of claim 1, further includes an anchor pad on the anchor portion of the self-lifting spring finger.

5. The planar fabricated structure of claim 4, the self-lifting spring finger comprising;

a non built-in stress gradient metal; and an overlaver portion with a built-in stress gradient.

6. The planar fabricated structure of claim 1, further includes the tip having a shape selected from a group of figures consisting of convex structures such as a circle, triangle, square, rectangle, parallelogram, trapezoid, rhombus, octagon, pentagon, and hexagon, and combinations thereof, as well as re-entrant structures as exemplified in fountain pens.

7. The planar fabricated structure of claim 1, wherein the fabricated structure is patterned and self-assembling.

8. The planar fabricated structure of claim 1, wherein the self-lifting spring finger may further include a counter moment layer processed onto the end of the finger to create a vertical segment;

wherein an unbalanced part of the finger is designed to bend 90 degrees.

9. The planar fabricated structure of claim 1, further comprising:

a release layer.

10. The planar fabricated structure of claim 9, wherein the release portion of the self-lifting spring finger lifts away from the substrate after the release layer is at least partially etched away from the release portion of the self-lifting spring finger during fabrication of the structure.

11. The planar fabricated structure of claim 1, further comprising:

a support pad attaching the unlifted anchor portion of the self-lifting spring finger to the substrate.

12. The planar fabricated structure of claim 1, wherein the self-lifting spring finger is fabricated with internal stresses such that stress nearest the substrate is compressive and stress farther from the substrate is tensile such that, when the release portion is not attached to the substrate, the release portion bends away from the substrate.

13. The planar fabricated structure of claim 1, wherein the tip at the distal end of the release portion of the self-lifting spring finger is shaped to facilitate capillary definition of agglomerated positively charged particles in conjunction with electrostatic extraction of marking fluid.

14. The planar fabricated structure of claim 1, wherein the self-lifting spring finger is transformed during fabrication into a relaxed state that leaves the release portion released from the substrate such that the tip of the release portion is extending away from the substrate.

* * * * *